US006647917B1

(12) United States Patent
Hoyt

(10) Patent No.: US 6,647,917 B1
(45) Date of Patent: Nov. 18, 2003

(54) PULPIT MOUNTED ROTATING BOWSPRIT

(76) Inventor: John Garrison Hoyt, One Maritime Dr., Portsmouth, RI (US) 02871

( * ) Notice: Subject to any disclaimer, the term of this patent is extended or adjusted under 35 U.S.C. 154(b) by 0 days.

(21) Appl. No.: 10/165,833

(22) Filed: Jun. 7, 2002

(51) Int. Cl.[7] ..... B63B 17/00
(52) U.S. Cl. ..... 114/364; 114/343
(58) Field of Search ..... 114/364, 343

(56) References Cited

U.S. PATENT DOCUMENTS 1,891,555 A 12/1932 Rockwood
4,352,338 A * 10/1982 Wilson ..... 114/364
5,937,779 A * 8/1999 Murnikov ..... 114/104

* cited by examiner

*Primary Examiner*—Jesus D. Sotelo
(74) *Attorney, Agent, or Firm*—Barlow, Josephs & Holmes, Ltd.

(57) ABSTRACT

A gate like device is hinged to a bow pulpit of a sailboat and acts as a swinging bowsprit to which a spinnaker may be removably affixed.

5 Claims, 2 Drawing Sheets

PULPIT MOUNTED ROTATING BOWSPRIT

BACKGROUND OF THE INVENTION

To sail downwind it is advantageous to use some form of spinnaker. In the past it has been customary to use a spinnaker pole that is either affixed at one end to the mast or to the bow as seen in my prior U.S. Pat. Nos. 4,292,910 and 4,501,217. There are also retracting poles sometimes carried inside the hulls that extend forward to attach to the tack of a spinnaker. Recently as the result of sail developments, the asymmetrical spinnaker, that is one with a defined luff, has proven to be easier to handle and faster in off-wind sailing as opposed to the long established symmetrical spinnaker. The most popular pole is one that extends from the bow usually from a socket in the hull. This means that the spinnaker is only effective on a reach for when going downwind the spinnaker will be blanketed by the mainsail. For racing boats this means a deck mounted pole to extend to weather for this is not only more efficient but it balances the boat.

The only suggestions in the prior art of means to extend the luff of a sail other than on line are in the Rockwood U.S. Pat. No. 1,891,555 and in Graham Dalton's new Open 60 with an articulating bowsprit. These bowsprits that have been developed are either housed on or under the foredeck and require care to get around the forestay deck attachment. Also they must be fairly long to get the necessary projection to weather. In general they are limited in the angle to which the poles may be articulated, generally about twenty degrees from the centerline.

SUMMARY OF THE INVENTION

The instant invention utilizes an existing structure that is commonly used for deck safety, the bow pulpit, as a base structure for mounting a short length bowsprit device or swinging gate that can lie along the lifelines when not in use. The swinging gate will thus comprise at least a horizontal member interconnected with a vertical support post with the vertical member hinged to the nose upright member of a bow pulpit. The invention enables an articulating bowsprit to be a rigid triangle constructed of stainless tubing instead of a large bulky tube.

DESCRIPTION OF THE PREFERRED EMBODIMENT

Figure 1:
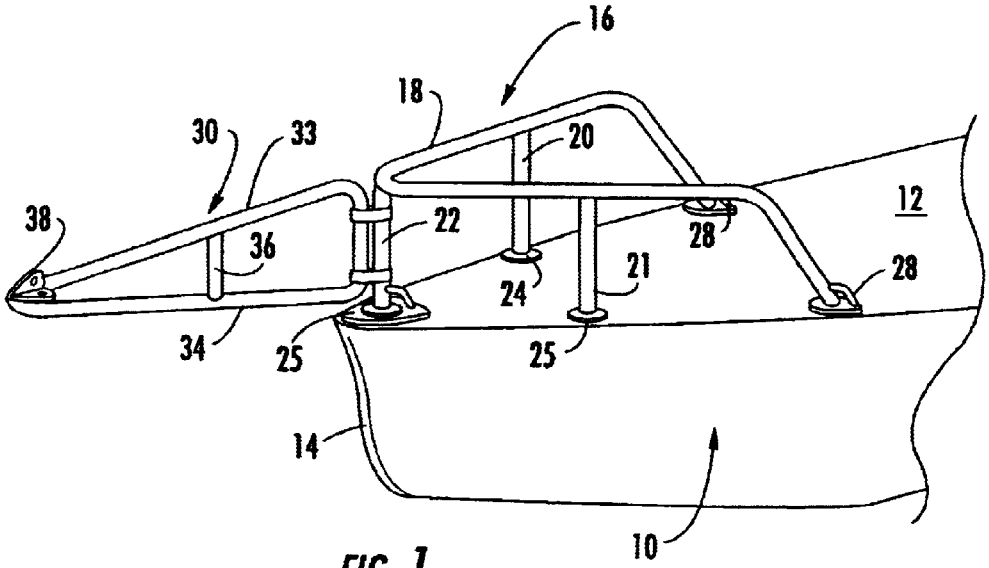
FIG. 1 shows the bow of a sailboat with the pulpit attachment is extended position.

With reference to FIG. 1 there is illustrated the forward section of a sailboat 10 having a deck 12. Mounted on the deck at the bow 14, is a pulpit generally designated 16. The pulpit is made up of a U-shaped horizontal rail 18 that has vertical support members 20, 21, and a nose member 22, each of which is fastened to the deck with integral flange plates 24, 25, and 26, As illustrated the horizontal rail 18 terminates in flange plates 28, 28'.

Figure 3:
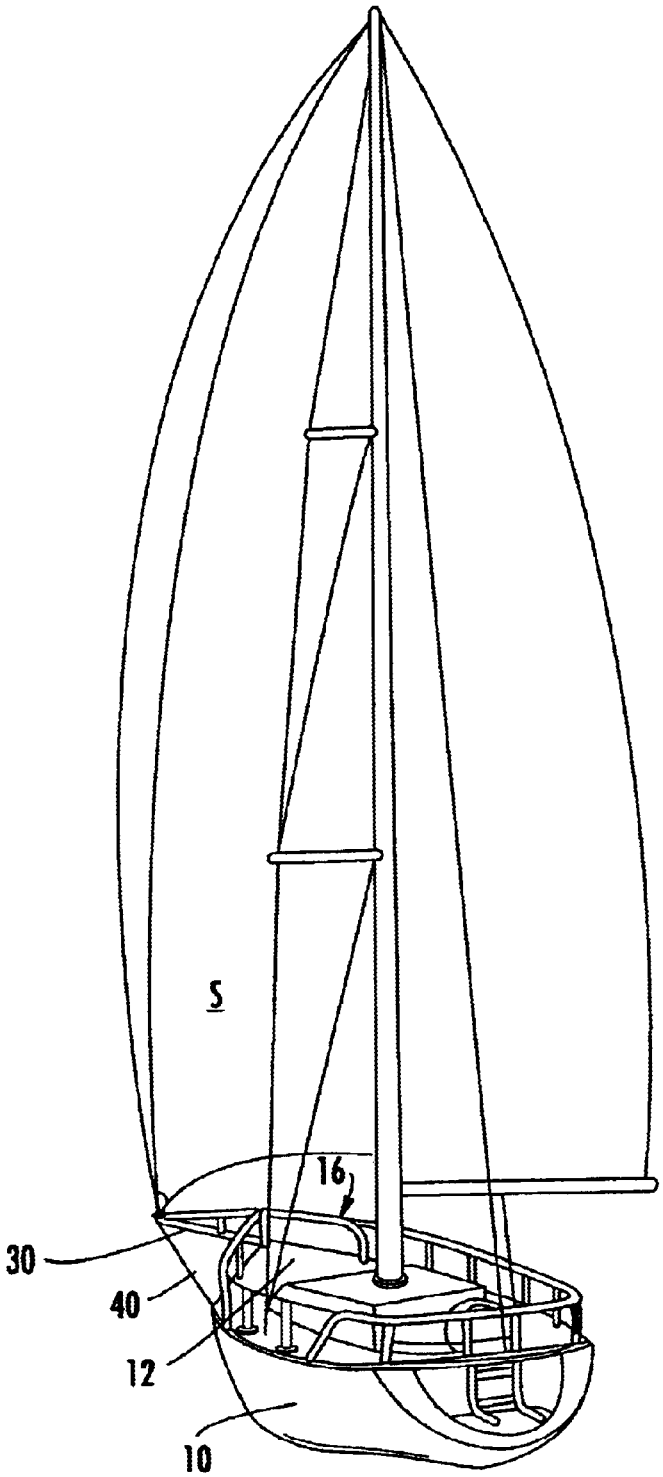
FIG. 3 is a perspective view of a sailboat with the attachment in use.

A swinging gate or bowsprit 30 is constructed in the form of a triangle. The base of the triangle is suitably hinged to the vertical nose support member 22 by means designated 29. Bridging post 36 suitably braces the legs 32, 34. At the end of the swinging gate, an eye 38 is secured providing an aperture to which the tack of a spinnaker may be fastened. As seen in FIG. 3, the guy or control line is also attached at this position either to the eye or the cringle in the sail S and is led aft to a fastening on the deck. As is understood in the field, a sheet attaches to the other end of the sail S and is led aft on the other side to another fastening means.

Figure 2:
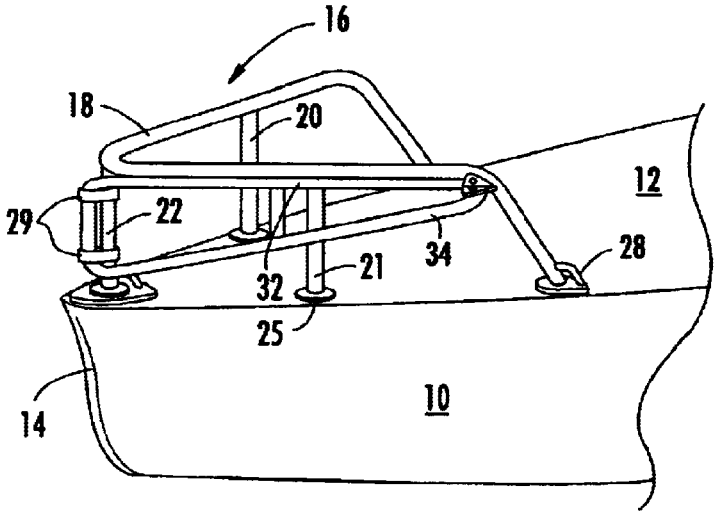
FIG. 2 is a similar view of the pulpit attachment in stowed position.

As can be seen in FIG. 2, the swing gate may be stowed by bringing it alongside the railing members. The arrangement provides an articulating "bowsprit" that is a rigid right triangle constructed of stainless steel tubing and is much easier to handle than a bulky spinnaker pole. It would also be noted that with the gate folded back along the railing it allows the crew a much safer an convenient attachment and detachment of the spinnaker tack as currently one has to bend over the bow to attach to a pole.

In constructing the swinging gate the loads on the gate are readily seen by referring to FIG. 3. At the end of the gate, there is an upward component and a lateral component the later of which is balanced by the guy line that leads aft. There will also be a longitudinal component that will normally be a force directed toward the bow pulpit. Thus, in many cases normal one inch diameter tubing may not be adequate in come installations.

It will be seen that the instant invention provides a relatively simple device that allows the spinnaker to receive more clear air than a centerline bowsprit.

I claim:

1. In a sailing boat having a bow pulpit with horizontal and vertical members, a device comprising at least a horizontal member and a support post connected thereto, said device hinged to nose upright member of the bow pulpit whereby the device may be rotated from a projecting position to a stowed position.

2. In a sailing boat as in claim 1 wherein the bow pulpit extends away on both sides from the bow of the boat.

3. In a sailing boat as in claim 1 wherein the horizontal member of the device has a fastening eye for attachment of a portion of a sail.

4. In a sailboat having a mast, a bow pulpit affixed to the sailboat ahead of the mast, said bow pulpit having a vertical post at the bow and side rails with supports, a device defined by a frame, said device hinged to the said vertical post.

5. In a sailboat as in claim 4 wherein the device is formed in a triangular shape and the base of the triangle shape is hinged to said vertical post.

* * * * *